United States Patent [19]

Wong

[11] Patent Number: 4,713,039

[45] Date of Patent: Dec. 15, 1987

[54] GYROSCOPIC TOY

[75] Inventor: Raymond Wong, Union City, Calif.

[73] Assignee: Wong & Bibaoco, Union City, Calif.

[21] Appl. No.: 909,170

[22] Filed: Sep. 19, 1986

[51] Int. Cl.[4] ..... A63H 33/26

[52] U.S. Cl. ..... 446/233; 446/258; 446/484

[58] Field of Search ..... 446/233, 420, 484, 485, 446/258, 259

[56] References Cited

U.S. PATENT DOCUMENTS

| | | | |
|---|---|---|---|
| 2,950,641 | 8/1960 | Bruetting | 446/258 |
| 3,153,968 | 10/1964 | Fuchs | 446/258 |
| 3,628,285 | 12/1971 | Murakami | 446/233 |
| 3,945,146 | 3/1976 | Brown | 446/485 |
| 4,277,912 | 7/1981 | Hsien | 446/233 |
| 4,282,681 | 8/1981 | McCaslin | 446/484 |
| 4,536,167 | 8/1985 | Hughes | 446/484 |
| 4,563,160 | 1/1986 | Lee | 446/485 |

FOREIGN PATENT DOCUMENTS

| | | | |
|---|---|---|---|
| 1127849 | 7/1982 | Canada | 446/485 |
| 656951 | 9/1951 | United Kingdom | 446/233 |

*Primary Examiner*—Sakran: Victor N.
*Attorney, Agent, or Firm*—Linval B. Castle

[57] ABSTRACT

A battery driven toy top containing a motor rotated flywheel enclosed in a domed housing. The top may be spun on either the dome or preferably on the opposite end of the tubular housing and contains noise generators and flashing lights controlled by a novel centrifugal switch.

6 Claims, 6 Drawing Figures

FIG-1-
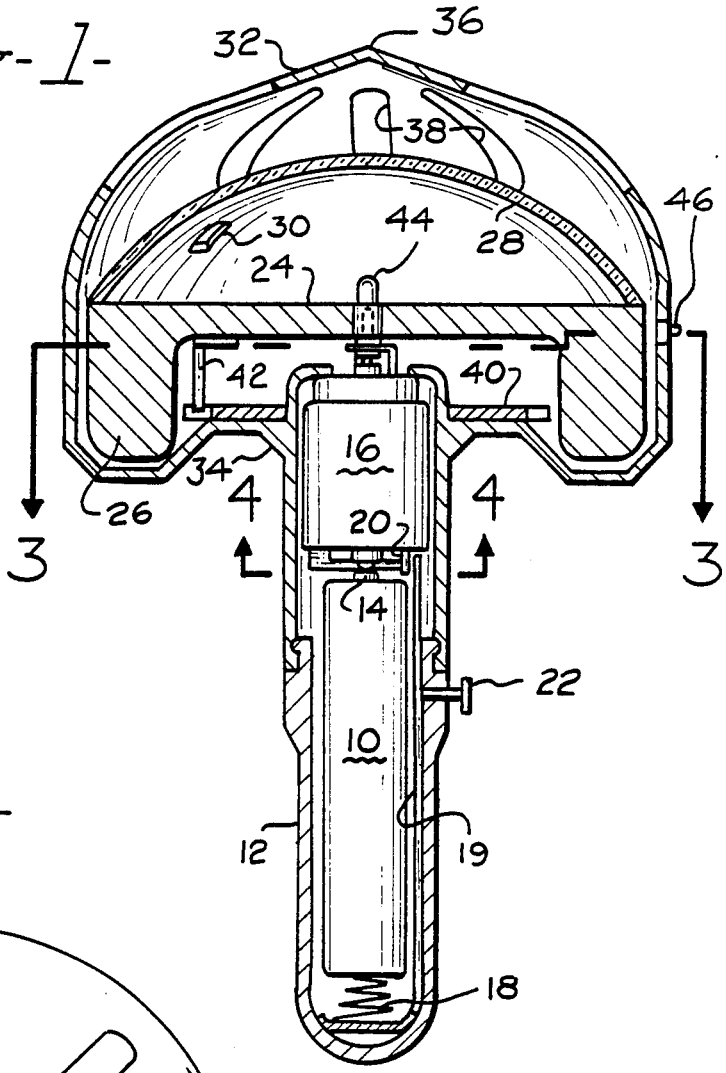
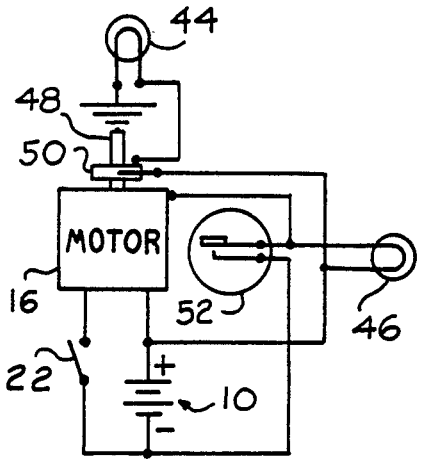
FIG-4-
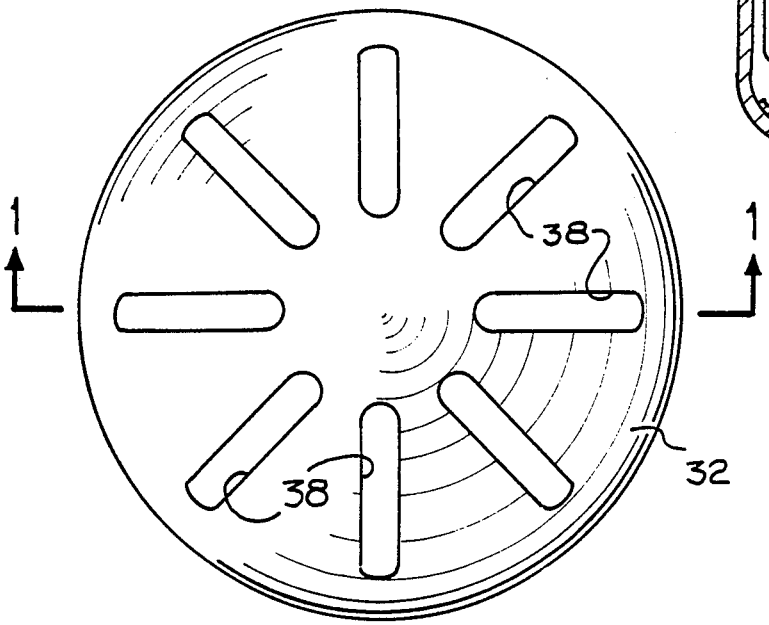
FIG-2-

FIG. 3
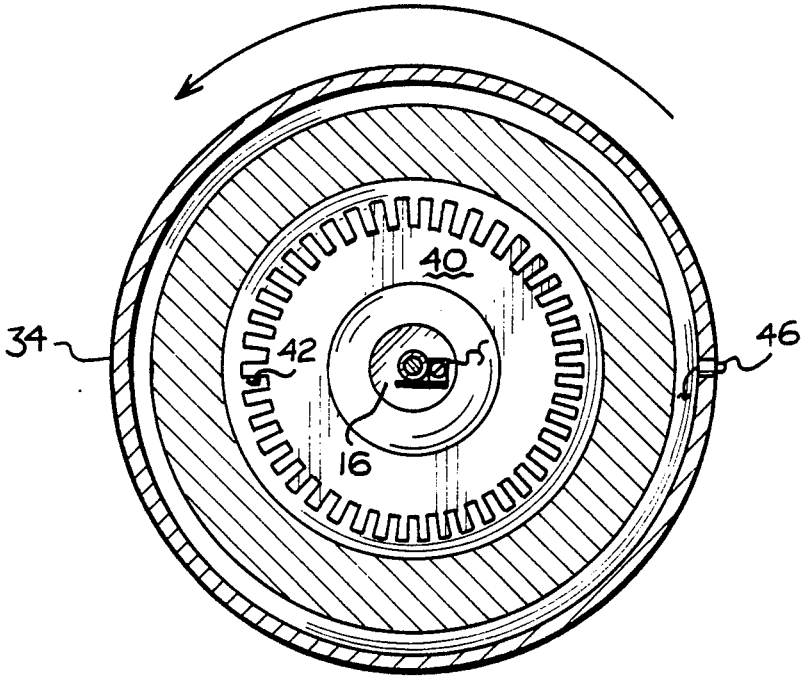
FIG. 5
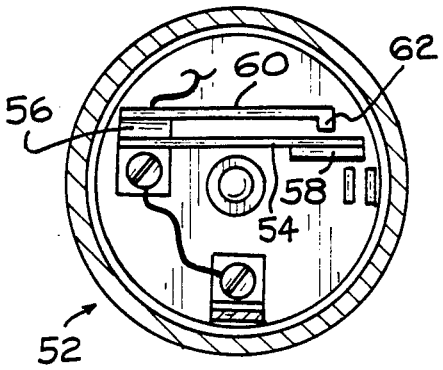
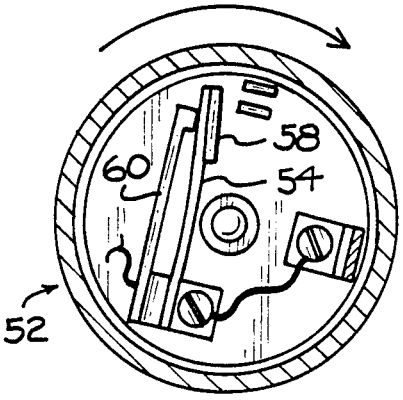
FIG. 6

GYROSCOPIC TOY

BRIEF SUMMARY OF THE INVENTION

This invention relates generally to toys and particularly to a novel electrically driven gyroscopic toy top that emits unusual sounds and lights during operation.

The toy top is not only an inexpensive and novel adult conversation piece but also is an important teaching device for young children and can demonstrate gyroscope operations, variations in sound pitch with rotational velocity, electrical switching and even the theory of a centrifugal switch. The toy top is completely safe from prying fingers of very small children and the single 1½ volt battery, inaccessible to infants, cannot product electrical shock or burns.

Briefly described, the toy top includes a tubular plastic lower housing containing a small battery, motor, and a momentary contact switch for directing battery power to the motor. A rotatable flywheel having an attached thin plastic dome is connected to the motor shaft and both the flywheel and dome are enclosed within an outer dome which is part of an upper housing. Noise is generated from two sources: a spoked disc attached to the housing is raked by a resilient finger depending from the flywheel; and a hole in the flywheel dome produces a resonant varying howl as the flywheel rotates. A small lamp centered on the flywheel and a second lamp at the exterior of the outer dome flash in response to a centrifugal switch which may be mounted between the battery and motor. These components coupled to the housing normally remain stationary but will rotate in the direction of the flywheel when the flywheel is brought up to speed, the momentary switch is opened and the top is released upon a flat surface.

BRIEF DESCRIPTION OF THE DRAWINGS

In the drawings which illustrate the preferred embodiment of the invention:

FIG. 1 is a sectional elevational view of the toy top and illustrates the various components therein;

FIG. 2 is a top view of the top illustrating the slotted dome thereof;

FIG. 3 is a sectional plan view taken along the lines 3—3 of FIG. 1;

FIG. 4 is a schematic diagram of the electrical circuitry of the toy top;

FIG. 5 is a sectional plan view taken along the lines 5—5 of FIG. 1 and illustrates the centrifugal switch of the toy top; and FIG. 6 is a sectional plan view of the centrifugal switch of FIG. 5 illustrating it in a closed condition during its rotation.

DETAILED DESCRIPTION OF THE PREFERRED EMBODIMENT

FIG. 1 is a sectional elevation view illustrating a small penlight size battery 10 preferably enclosed within a tubular non-insulating lower housing 12. The positive terminal 14 of the battery is in electrical contact with one terminal of a small electric motor 16, whereas the negative terminal of the battery is coupled through a spring 18 to a resilient conductive strip 19 which extends up along the inner wall of the housing 12 to a point adjacent the second terminal 20 of the motor 16. A small stud 22 radially extending through the wall of the housing and against the resilient conductive strip operates as a momentary push-button switch when depressed to force the end of the conductive strip 19 against the second terminal 20 of the motor.

Connected to the rotatable shaft of the motor 16 is a relatively heavy flywheel 24 that is preferably formed of solid plastic and which, for the additional mass at a relatively low center of gravity, may have a dependent annular peripheral section 26. Attached to, and overlying the the upper surface of the flywheel 24 is a transparent or translucent plastic dome 28 having a small opening 30 therein at a position about half way between the dome's equator and azimuth. This opening produces a low eerie howl when the flywheel dome is rapidly rotated.

The outer dome 32 forms a part of an upper housing 34 which is attachable to the tubular lower housing 12. The dome 32 preferably has a pointed center peak 36 and, as shown in the top plan view of FIG. 2, contains a plurality of openings or radially extending slots 38.

A second noise generator that emits a sound having a frequency that varies with the difference in rotational velocity between the flywheel 24 and housing 34 is formed by a toothed wheel 40 attached to the housing 34 as shown in FIG. 1 and the plan view of FIG. 3. The teeth in the wheel 40 are engaged by a resilient finger 42 attached to the lower surface of the flywheel 24. The sound, which is akin to a stick drawn along a picket fence, together with the eerie sound produced by the rotating dome slot reminds one of the starting of an aircraft jet engine.

Before preceeding with further descriptions of the toy top, a brief explanation of its operation will be given. Initially, the top is held in the hand while the momentary switch 22 is held closed to start the motor 16 and to bring the flywheel 24 up to full rotational speed. The jet engine sound from the two sound sources increases in intensity with rotational velocity. The switch 22 is then released and the top is axially placed on a flat surface, either on the center peak 36 of the dome 32 but preferably on the opposite or lower housing end. When thus released the housing, which was originally non-rotating, now starts rotating in the same direction as that of the flywheel 24. When the rotation of the housing begins, small lights within the top start flashing to produce a interesting effect, particularly in a darkened area.

FIG. 1 illustrates the location of two small lamps 44, 46 either or both of which may be used in the toy top. The lamps are very small and light weight and are preferably the so-called "grain-of-wheat" lamps such as used for illuminating digital wrist watches. One of the lamps 44 is mounted to the end of the motor shaft 48 that extends from the top surface of the flywheel 24; the second lamp 46 may be mounted in the wall of the upper housing 32 at the approximate location of its equator. Each lamp is powered by the battery 10 in circuitry that will now be described.

FIG. 4 is an electrical schematic diagram of the circuitry of the toy top. The housing and rotatable shaft of the motor 16 is conductive but is insulated from the internal motor circuitry. In the schematic diagram, the positive battery terminal is coupled directly to the positive motor terminal and the negative motor terminal is connected through the momentary contact switch 22 to the negative battery contact so that a closure of the switch 22 will activate the motor 16.

The positive battery contact is also coupled to one side of the lamp 46 and also coupled to one side of the rotating lamp 44 through a brush and commutator 50 that is axially connected to but insulated from the rotatable motor shaft 48.

The negative battery contact is coupled through a centrifugal switch 52, to be subsequently described, to the negative side of the lamp 46 and to the conductive motor housing which provides continuity through the conductive motor shaft 48 to the negative side of the lamp 44.

FIG. 5 is a plan view taken along the lines 5—5 of FIG. 1 of the centrigual switch 52 which preferably is located between the battery 10 and motor 16. The switch 52 includes a elongated resilient conductive arm 54 secured at a first end on a insulating block 56 and supporting a small weight 58 at its second end. Spaced from and substantially parallel with the arm 54 is a conductor such as a wire 60 having an end 62 adapted to make electrical contact with the conductive arm 54 spaced therefrom. The weighted arm 54 is spaced from the longitudinal axis of the top, is spaced therefrom and, for optimum effectiveness, lies along a line substantially perpendicular to a radial line so that any rotation of the lower housing 12 and centrifugal switch 52 about the axis will force the weighted end of the arm 54 to deflect outward and into contact with the conductive wire 60.

The centrifugal switch 52 is a part of the stationary part of the toy top which normally would not rotate. However, when the top has been brought up to full rotational speed and released on a flat surface, the housing begins rotating as previously explained. This rotation in the direction shown by the arrow in FIG. 6 centrifugally forces outward the small weight 58 on the resilient conductive arm 54 until the arm 54 makes electrical contact with the conductive wire 60. Normal variations in the rotational velocity of the top housing may cause intermittent circuit openings of the centrifugal switch to result in flashing of the lamps. It should be noted that, since the diameter of the motor 16 is only about three-quarters of an inch, the total length of the conductive arm 54 and wire is approximately one-quarter inch.

Having thus described my invention, what I claim is:

1. An electrically rotated toy top comprising:

a tubular first housing;

an electric motor within said first housing, said motor having an extending rotatable shaft coaxial with said tubular first housing;

a battery within said tubular first housing, said battery having a first terminal in contact with a first motor terminal and a second terminal in contact with a second motor terminal through a momentary contact electrical switch;

a rotatable flywheel coupled to said motor shaft, said flywheel including an overlying hollow dome with a small opening therein;

a second housing, said second housing including a second hollow dome closely overlying the hollow dome on said rotatable flywheel, said second hollow dome having a plurality of openings to form first sound generating means upon relative rotation between said hollow domes; and second sound generating means including a multiple spoked non-rotatable disc centered around the shaft end of said motor and a resilient member coupled to said rotatable flywheel and extending into the spokes of said disc.

2. The toy top claimed in claim 1 wherein the hollow dome on said second housing is formed with a center peak for the spinning of said top on said peak.

3. The toy top claimed in claim 1 wherein said momentary contact switch includes a manually operable pushbutton extending from the surface of said first housing.

4. The toy top claimed in claim 1 further including at least one electrical lamp coupled to said top, said lamp being coupled to said battery through a centrifugal switch closed by the rotation of said first housing.

5. The toy top claimed in claim 4 wherein one lamp is located in the surface of said second housing.

6. The toy top claimed in claim 4 wherein one lamp is coupled to the end of said rotatable motor shaft, the first pole of said lamp being coupled to one battery terminal through a brush commutator coupled to and insulated from said motor shaft, the second pole of said battery being coupled through said motor shaft and motor housing to said centrifugal switch.

* * * * *